US011448071B2

(12) United States Patent
Sawitzki et al.

(10) Patent No.: US 11,448,071 B2
(45) Date of Patent: Sep. 20, 2022

(54) VANE MOTOR

(71) Applicant: J.D. Neuhaus Holding GmbH & Co. KG, Witten (DE)

(72) Inventors: Ewald Sawitzki, Bochum (DE); Simon Brose, Hattingen (DE)

(73) Assignee: J.D. Neuhaus Holding GmbH & Co. KG, Witten (DE)

( * ) Notice: Subject to any disclaimer, the term of this patent is extended or adjusted under 35 U.S.C. 154(b) by 38 days.

(21) Appl. No.: 16/966,239

(22) PCT Filed: Jan. 30, 2019

(86) PCT No.: PCT/EP2019/052251

§ 371 (c)(1),
(2) Date: Jul. 30, 2020

(87) PCT Pub. No.: WO2019/149753

PCT Pub. Date: Aug. 8, 2019

(65) Prior Publication Data

US 2021/0047929 A1 Feb. 18, 2021

(30) Foreign Application Priority Data

Feb. 2, 2018 (DE) ..... 10 2018 102 393.6

(51) Int. Cl.
*F03C 2/00* (2006.01)
*F03C 4/00* (2006.01)
(Continued)

(52) U.S. Cl.
CPC ..... *F01C 21/04* (2013.01); *F01C 1/344* (2013.01); *F04C 18/3442* (2013.01); *F04C 29/023* (2013.01); *F04C 2240/603* (2013.01)

(58) Field of Classification Search
CPC .. F04C 18/344; F04C 18/3442; F04C 29/023; F04C 2210/1005; F04C 2230/00;
(Continued)

(56) References Cited

U.S. PATENT DOCUMENTS 1,967,034 A * 7/1934 Lipman ..... F04C 29/02 418/97
3,084,677 A 4/1963 Mitchell
(Continued)

FOREIGN PATENT DOCUMENTS

DE 1 706 060 U 9/1955
DE 971 505 C 2/1959
(Continued)

OTHER PUBLICATIONS

International Search Report and Written Opinion in International Application No. PCT/EP2019/052251, dated Apr. 30, 2019.

*Primary Examiner* — Theresa Trieu
(74) *Attorney, Agent, or Firm* — Nixon Peabody LLP

(57) ABSTRACT

A vane motor with a rotor body driven by compressed air having vane gaps for radially movable vanes and a rotor shaft for rotatably bearing the rotor body relative to a motor bushing. A method for lubricating a vane motor that ensures particularly long, low-service operation is provided. The rotor shaft is configured as a hollow shaft with a first lubricant reservoir in the interior. The first lubricant reservoir has a lubricant filling opening accessible from the outside of the vane motor. The first lubricant reservoir is connected by at least one radial lubricant hole to at least one further lubricant reservoir arranged in a section of the rotor body between two vane gaps, and/or is connected to an outlet opening arranged in one of the vane gaps for supplying lubricant into the vane gap.

13 Claims, 4 Drawing Sheets

(51) Int. Cl.

| | |
|---|---|
| ***F04C 2/00*** | (2006.01) |
| ***F01C 21/04*** | (2006.01) |
| ***F01C 1/344*** | (2006.01) |
| ***F04C 29/02*** | (2006.01) |
| ***F04C 18/344*** | (2006.01) |

(58) Field of Classification Search
CPC ..... F04C 2230/60; F04C 2240/603; F01C 1/344; F01C 1/3442; F01C 21/04
See application file for complete search history.

(56) References Cited

U.S. PATENT DOCUMENTS 3,125,200 A 3/1964 Kaman
3,743,453 A * 7/1973 Abendschein ..... F04C 29/02 418/88
4,144,866 A * 3/1979 Hakner ..... F04C 29/12 418/186
4,490,100 A * 12/1984 Okazaki ..... F04C 29/02 418/98
5,087,180 A * 2/1992 Clapp ..... F04C 27/005 418/133
6,413,062 B1 * 7/2002 Peters ..... F04C 29/02 418/99

FOREIGN PATENT DOCUMENTS

| | | | | |
|---|---|---|---|---|
| DE | 1 538 942 | A1 | 4/1970 | |
| DE | 699 01 186 | T2 | 1/2003 | |
| DE | 10 2009 038 132 | A1 | 8/2009 | |
| EP | 0 003 572 | A | 12/1991 | |
| FR | 1 000 099 | A | 2/1952 | |
| GB | 864 580 | A | 4/1961 | |
| GB | 1596109 | A * | 8/1981 | ..... F01C 21/0809 |
| WO | WO-0004276 | A1 * | 1/2000 | ..... F04C 29/02 |

* cited by examiner

VANE MOTOR

CROSS-REFERENCE TO RELATED APPLICATIONS

This application is a U.S. National Stage of International Application No. PCT/EP2019/052251, filed Jan. 30, 2019, which claims the benefit of Germany Patent Application No. 10 2018 102 393.6, filed Feb. 2, 2018, both of which are incorporated herein by reference in their entireties.

BACKGROUND OF THE INVENTION

The invention relates to a vane motor with a rotor body driven by compressed air with vane gaps for radially movable vanes, and with a rotor shaft for rotatably mounting the rotor body relative to a motor bushing. Moreover, the invention relates to a method for lubricating such a vane motor.

Vane motors are known in various embodiments from the prior art and are used for a wide range of applications, for example as a pneumatic motor for a hoist.

With such a vane motor, a rotor body is arranged eccentrically in a motor bushing. Longitudinal slots, the vane gaps, in which vanes are movably arranged, are in the rotor body. The operating fluid or respectively gas, for example compressed air, supplied to the vane motor is guided into chambers formed between the vanes. The compressed air then drives the motor so that the rotor body begins to rotate in the motor bushing. In so doing, the vanes can be pressed outward by springs and under the effect of the centrifugal force as the rotational speed increases, so that they lie sealingly against the motor bushing and thus form the chambers.

During operation, the vane motor must be lubricated, in particular due to the frictional contact of the vanes with the inner wall of the motor bushing. To accomplish this, several methods are known from the prior art as well as corresponding embodiments of vane motors.

A first method provides adding oil or another lubricant to the operating fluid, in particular the operating compressed air, so that this oil is distributed throughout the vane motor and ensures continuous and even lubrication. However, this yields the disadvantages that oil must first be added to the operating compressed air, and the oil then either has to be subsequently removed, or respectively recovered, or the used compressed operating air must be discarded in such a manner that the oil added and remaining in the operating compressed air does not enter the surroundings, or respectively environment. Both result in the fact that operation is only possible with complex and expensive systems, the oil consumption and hence the operating costs as well are high, and discharging oil into the environment is unavoidable to some extent.

Another method from the prior art provides disassembling the vane motor at regular intervals and providing the individual components with lubricating grease which ensures lubrication of the moving parts over a longer time period. However, this procedure has the disadvantage that the vane motor must be regularly disassembled, which is associated with major effort and long downtimes. Moreover, without disassembly, it is difficult to discern whether the vane motor still has sufficient lubrication which further shortens the necessary service intervals.

Finally, a pneumatic motor is already known from WO 00/04276 A1, wherein a rotor driven by compressed air rotates in a cylindrical motor bushing. In the rotor, cavities serve to receive a lubricant, and connecting paths are provided to transport the lubricant from the cavities into the motor bushing, wherein when assembling the pneumatic motor, the cavities are filled once with lubricant which is sufficient for the entire life, or respectively the period of time between two servicings. However, this has the disadvantage that the pneumatic motor, in particular under difficult operating conditions such as great heat and a strong load, regularly needs to be completely disassembled for servicing, wherein the cavities then can be refilled with lubricant.

It can therefore be considered the object to provide a vane motor as well as a method for lubricating a vane motor that ensure particularly long, low-service operation, wherein the vane motor is easy to service and can be operated very economically and in an environmentally friendly manner.

The object is achieved according to the invention by a vane motor according to the invention as well as a method according to the invention. Advantageous further embodiments of the invention are set forth in the dependent claims.

BRIEF SUMMARY OF THE INVENTION

The vane motor according to the invention has a rotor body driven by an operating fluid, in particular compressed air with vane gaps for radially movable vanes, and a rotor shaft for rotatably mounting the rotor body relative to a motor bushing. According to the invention, the rotor shaft is designed as a hollow shaft with a first lubricant reservoir in the interior, wherein the first lubricant reservoir has a lubricant filling opening accessible from outside of the vane motor, and wherein the first lubricant reservoir is connected by at least one radial lubricant hole to at least one further lubricant reservoir arranged in a section of the rotor body between two vane gaps, and/or to an outlet opening arranged in one of the vane gaps to supply lubricant to the vane gap, wherein the first lubricant reservoir is provided for receiving and storing lubricant and is formed such that there is no continuous supply of lubricant during operation of the vane motor.

Moreover, the invention relates to a method for lubricating a vane motor, in particular a vane motor according to the invention, wherein initially, a lubricant press is connected to a lubrication nipple arranged on a rotor shaft of the vane motor and accessible from outside of the vane motor, and then a lubricant is pressed into at least one first lubricant reservoir arranged in the rotor shaft provided for receiving and storing lubricant as well as preferably also into additional lubricant reservoirs in a rotor body of the vane motor connected to the first lubricant reservoir by radial lubricant holes. Then the lubricant press is disconnected from the lubrication nipple and the vane motor is started up, wherein by rotating the rotor body and the rotor shaft, the lubricant is discharged from the at least one lubricant reservoir through at least one outlet opening to the surface of the rotor body and/or into a vane gap of the rotor body, wherein there is no continuous supply of lubricant during operation of the vane motor.

The embodiment of the vane motor according to the invention as well as the method according to the invention allow easy lubrication of the vane motor in a ready-to-use state, i.e. the vane motor does not have to be disassembled to do this. On the one hand, this enables particularly long and low-wear operation, and on the other hand allows the downtimes for required servicing to lubricate the motor components to be reduced to a minimum. Moreover, the invention allows the vane motor to be operated with oil-free compressed air, as well as with a particularly low lubricant consumption which minimizes operating costs and protects the environment.

The vane motor is preferably an expansion motor, in particular a gas expansion motor. Also preferably, the vane motor is provided to drive a hoist, and in particular a chain of a hoist. The vane motor can however be not just a pneumatic motor, but rather in principle can also be operated with a fluid, i.e., hydraulically.

While the vane motor is operating, the rotor body rotates in a cylindrical motor bushing and is arranged eccentrically. The rotation of the rotor body preferably occurs jointly with the rotor shaft and/or around the central longitudinal axis of the rotor shaft. The rotor body has vane gaps, wherein in each vane gap, a vane is arranged that moves radially around the rotor shaft during a rotation of the rotor body, and/or slides on the motor bushing, thereby forming a closed chamber. The rotor body and the rotor shaft can in principle be formed of any desired material and have any desired shape. Preferably, the rotor body is arranged on the rotor shaft in a rotationally fixed manner, and particularly preferably, the rotor shaft and the rotor body are designed as a single part and/or materially bonded to each other.

According to the invention, the rotor shaft is designed as a hollow shaft and has a lubricant reservoir in the interior to receive a lubricant, in particular a lubricating grease. The hollow shaft is hollow over at least part of its length, particularly preferably over the entire length, or respectively has a recess that is provided to receive a lubricant. Also preferably, the lubricant reservoir is formed rotationally symmetrical with the rotational axis of the rotor shaft, and/or has a central longitudinal axis that lies in the rotational axis of the rotor shaft. Most preferably, the first lubricant reservoir is formed by a cylindrical hole arranged in the middle of the rotor shaft.

First of all, the rotor shaft can have any desired diameter, and the lubricant reservoir any desired volume. Preferably, the volume of the first and/or each further lubricant reservoir is between 0.1 $cm^3$ and 500 $cm^3$, particularly preferably between 0.5 $cm^3$ and 50 $cm^3$, and most preferably between 1 $cm^3$ and 5 $cm^3$. Moreover, each further lubricant reservoir is preferably cylindrical, and particularly preferably formed by a cylindrical hole.

According to the invention, the vane motor has a lubricant filling opening accessible from the outside through which the lubricant can be added into at least the first lubricant reservoir. "Accessible from the outside" in this context means that the lubricant filling opening must be accessible to a user without having to disassemble any essential part of the vane motor. Preferably, the lubricant filling opening is arranged in the vane motor such that it is located in a surface of the vane motor in a ready-to-use state. With a vane motor installed in a hoist, the lubricant filling opening can however be covered and/or closed in order to prevent damage or contamination. Preferably in a hoist, a removable cover is arranged in front of the lubrication filling opening. Also preferably, the cover is easily removable, in particular, latched and/or releasably fastened by means of a few screws.

One possible embodiment of the invention provides that a radial lubricant hole connects the first lubricant reservoir in the rotor shaft to at least one additional lubricant reservoir in the rotor body. Preferably, the first lubricant reservoir is connected to each other lubricant reservoir by means of just one radial lubricant hole.

First of all, a radial lubricant hole can be formed as desired and have any desired cross-section. Preferably, the radial lubricant hole is formed by a hole with a round cross-section and/or consistent diameter. In principle, a radial lubricant hole also does not have to run exclusively in a radial direction with reference to the axis of rotation of the rotor body, or respectively to the rotor shaft, but rather can also contain just one radial component. The lubrication hole can for example also run diagonally at least sectionally through the rotor body and/or the rotor shaft. Particularly preferably, each lubrication hole has a straight trajectory, and most preferably, two lubrication holes run along a common linear trajectory on opposite sides of the axis of rotation of the rotor body. Also preferably, the central longitudinal axis of all lubrication holes intersects the axis of rotation of the rotor body, or respectively the rotor shaft.

The outlet opening of the lubricant reservoir according to the invention in the vane gap can first of all be arranged as desired on, or respectively in, the vane gap and have any desired shape. In principle, the outlet opening connects a surface of the vane gap to the interior of at least one lubricant reservoir. Preferably, the outlet opening is formed by a round hole that particularly preferably has a consistent diameter along the entire length. Also preferably, a central longitudinal axis of the outlet opening runs at a right angle to a surface of the vane gap. Particularly preferably, the outlet opening is arranged in a surface of the vane gap facing the rotor shaft, in particular the floor of the vane gap relative to the direction of movement of the vane in the vane gap.

In a preferred embodiment of the vane motor according to the invention, a further lubricant reservoir is arranged in at least one section of the rotor body between two vane gaps, wherein the further lubricant reservoir has at least one outlet opening for lubricant onto a surface of the rotor body, whereby on the one hand, the lubricant volume that can be received and stored in the vane motor can be advantageously increased, and on the other hand, particularly effective and extensive lubrication of the rotor body as well as of the vanes can be achieved. Preferably, each of the further lubricant reservoirs extends the entire length of the rotor body, in particular in the direction of the rotor shaft, or respectively the axis of rotation of the rotor body. Also preferably, the further lubricant reservoir is arranged parallel to the first lubricant reservoir in the rotor shaft. The further lubricant reservoir of the rotor body and in particular each further lubricant reservoir is preferably formed by a cylindrical hole, and particularly preferably has the same diameter and/or the same inner volume as the first lubricant reservoir in the rotor shaft.

The at least one outlet opening from the further lubricant reservoir can first of all be designed as desired. Preferably, the outlet opening is formed by a hole that runs at least parallel to and particularly preferably along the central longitudinal axis of the further lubricant reservoir. Also preferably, a further lubricant reservoir has several, in particular two outlet openings, wherein particularly preferably, the distance from the outlet openings to the axis of rotation of the rotor body, or respectively to the rotor shaft, is the same. Most preferably, all outlet openings of further lubricant reservoirs have the same distance to the rotor shaft.

An advantageous embodiment of the vane motor according to the invention provides that the outlet opening of the further lubricant reservoir is arranged in at least one face of the rotor body and particularly preferably, an outlet opening is arranged in each of the two faces of the rotor body, in particular in an axial direction relative to the rotor shaft which easily prevents lubricant from being ejected during operation and simultaneously achieves even lubrication of the vane motor. Correspondingly, the further lubricant reservoir preferably does not have an opening, and in particular does not have an outlet opening in a radial direction. To simplify the production of the rotor body and in particular the radial lubricant hole, it may be necessary to first produce an opening in the region of a further lubricant reservoir, or respectively a hole in the radial direction that however is then closed again so that there is no outlet opening of the further lubricant reservoir in a radial direction during operation. Such a production hole can be closed in any desired manner, for example by arranging a plug or another component in the hole, by adding a hardening substance, in particular an adhesive, or by welding. The "face of the rotor body" is in particular understood to mean the side of the rotor body in the axial direction of the axis of rotation.

According to a preferred further embodiment of the vane motor according to the invention, the at least one and preferably all outlet openings of the further lubricant reservoir are closed by a sintering material or a membrane material through which the lubricant can pass, wherein the sintering material, or respectively the membrane material, advantageously permits on the one hand a slow and even dispensing of lubricant, or respectively a diffusion of grease contained in the lubricant, and on the other hand allows a pressure differential between the lubricant reservoirs and the exterior of the rotor body, or respectively the motor interior so that a pressure short circuit does not occur within the lubricant reservoir, or respectively lubricant reservoirs, even when there are several outlet openings in a lubricant reservoir and in particular a system consisting of several lubricant reservoirs connected to each other which makes it difficult or even prevents lubricant from leaving.

The sintering material can in principle be formed from any desired, in particular metal or ceramic material, as long as it is suitable to let the lubricant, or respectively a component of the lubricant, such as an oil contained in the lubricant, pass through. Alternatively or in addition, a membrane can be used that can also be formed of any desired metal, inorganic or organic material, for example plastic, wherein the membrane must possess permeability to the lubricant, or respectively a component thereof.

The sintering material, or respectively the membrane, is preferably pressed into the outlet opening, secured therein in a form fit, or integrally bonded thereto. The outlet opening provided with the sintering material, or respectively the membrane, also preferably has the same diameter as the particular lubricant reservoir. Especially preferably, the sintering material, or respectively the membrane, extends over the entire cross-section of the lubricant reservoir.

According to an advantageous embodiment of the vane motor according to the invention, at least two further lubricant reservoirs are arranged opposite each other in the rotor body relative to the rotor shaft, or respectively an axis of rotation of the rotor body, which allows an imbalance of the rotor body to be easily avoided. Particularly preferably, a further lubricant reservoir is arranged in each section of the rotor body between two vane gaps and most preferably, each further lubricant reservoir has a further opposing lubricant reservoir in the rotor body relative to the rotor shaft.

Also preferable is an embodiment of the vane motor in which just one single radial lubricant hole is connected to a single outlet opening arranged in one of the vane gaps to supply lubricant into the vane gap, which can easily prevent a pressure short circuit, in particular in the first lubricant reservoir. Such an embodiment can however have any desired number of further radial lubricant holes that are connected to at least one, preferably to one further lubricant reservoir each.

According to a preferred further embodiment of the vane motor according to the invention, the first lubricant reservoir extends over the entire length of the rotor shaft in an axial direction, wherein the first lubricant reservoir is closed at one end, in particular by a closure, or respectively a plug, and has the lubricant filling opening at the other end. Also preferably, a lubrication nipple that rotates with the rotor shaft for filling the lubricant reservoir, or respectively lubricant reservoirs, is arranged at the lubricant filling opening. In particular, the lubrication nipple is arranged to be accessible from the outside of the vane motor. Particularly preferably, the lubrication nipple is screwed into an end of the rotor shaft in the region of the first lubricant reservoir. Also preferably, the lubrication nipple is arranged axially to the rotor shaft, and/or runs precisely through the axis of rotation of the rotor shaft.

A particularly preferred embodiment of the vane motor is formed such that compressed air activation of the lubrication is possible, wherein the compressed air for operation of the vane motor can be used to press lubricant out of at least one lubricant reservoir. Particularly preferably, the amount of lubricant to be pressed out can be regulated by the applied pressure of the compressed air. Alternatively, a separate compressed air supply can be provided to activate or regulate lubrication. One possibility of such compressed air activation is to connect a compressed air access to at least one of the compressed air reservoirs so that air is pressed in, and pressure can thereby be exerted on the lubricant contained in the lubricant reservoir. Alternatively, at least one lubricant reservoir can have a disk, or respectively a corresponding piston that can move along the length of the lubricant reservoir, and compressed air can be applied to it from one side so that the other side can pass on the pressure to the lubricant located in the lubricant reservoir.

Alternatively or in addition, compressed air activation of the lubrication is possible in which an external lubricant reservoir is located next to the hoist and is connected to the lubricant filling opening, in particular by a hose to the lubrication nipple on the rotor shaft. By this external lubricant reservoir, a lubricant, in particular grease, can be pressed by compressed air into the internal first lubricant reservoir, wherein the size of the external lubricant reservoir can be selected as desired.

In an advantageous further embodiment of the vane motor according to the invention, the further lubricant reservoir is provided to receive and save lubricant so that lubricant does not have to be continuously supplied during the operation of the vane motor, and preferably long-lasting operation, particularly preferably over more than 10 operating hours and most preferably more than 100 operating hours can occur without supplying a lubricant to one of the lubricant reservoirs. At the same time, the lubricant reservoir and particularly preferably the entire vane motor is formed such that there is no connection by the at least one lubricant reservoir to an external lubricant supply during the operating state. On the other hand, the vane motor is also preferably formed such that lubricant can be introduced very easily and quickly into at least one of the lubricant reservoirs during a pause in operation.

BRIEF DESCRIPTION OF THE SEVERAL VIEWS OF THE DRAWINGS

An exemplary embodiment of the device according to the invention is explained in greater detail below with reference to the drawings. In the figures.

DETAILED DESCRIPTION OF THE INVENTION

Figure 1:
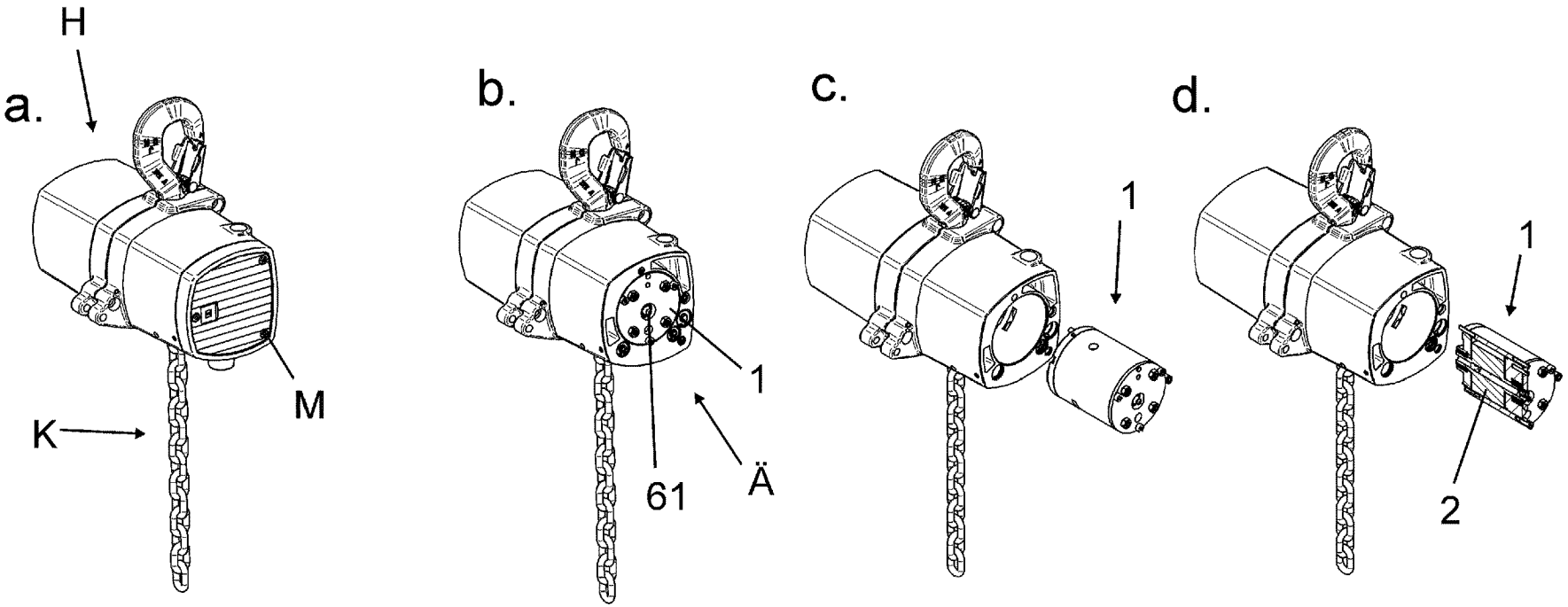
FIG. 1 shows several perspective views of the arrangement of a vane motor in a hoist.

By means of a hoist H portrayed in FIG. 1, a load on a chain K can be lifted and lowered. To drive the chain K, the hoist H has a vane motor 1 behind a motor cover M as well as additional components. The vane motor 1 has means for lubricating the motor components without the vane motor 1 having to be disassembled. When the motor cover M is removed, a lubrication nipple 61 is accessible from the outside Ä of the vane motor 1 (see FIG. 1*b*) so that lubrication of the fully assembled vane motor 1 installed in the hoist H is possible.

The vane motor 1 has a rotor body 2 rotatably arranged within a motor bushing 11. In order to enable rotation of the rotor body 2, it is integral with a rotor shaft 4 which is arranged eccentrically in the cylindrical motor bushing 11. Between the rotor shaft 4 and a motor housing, or respectively a part of the motor bushing 11, a bearing L is arranged at both ends of the rotor shaft 4. Moreover, a plurality of vanes are guided in vane gaps 3 of the rotor body 2 so that they form a closed chamber between a surface 21 of the rotor body 2 and the motor bushing 11, wherein the volume of this chamber changes when the rotor body 2 rotates due to the eccentric arrangement in the motor bushing 11.

Figure 2:
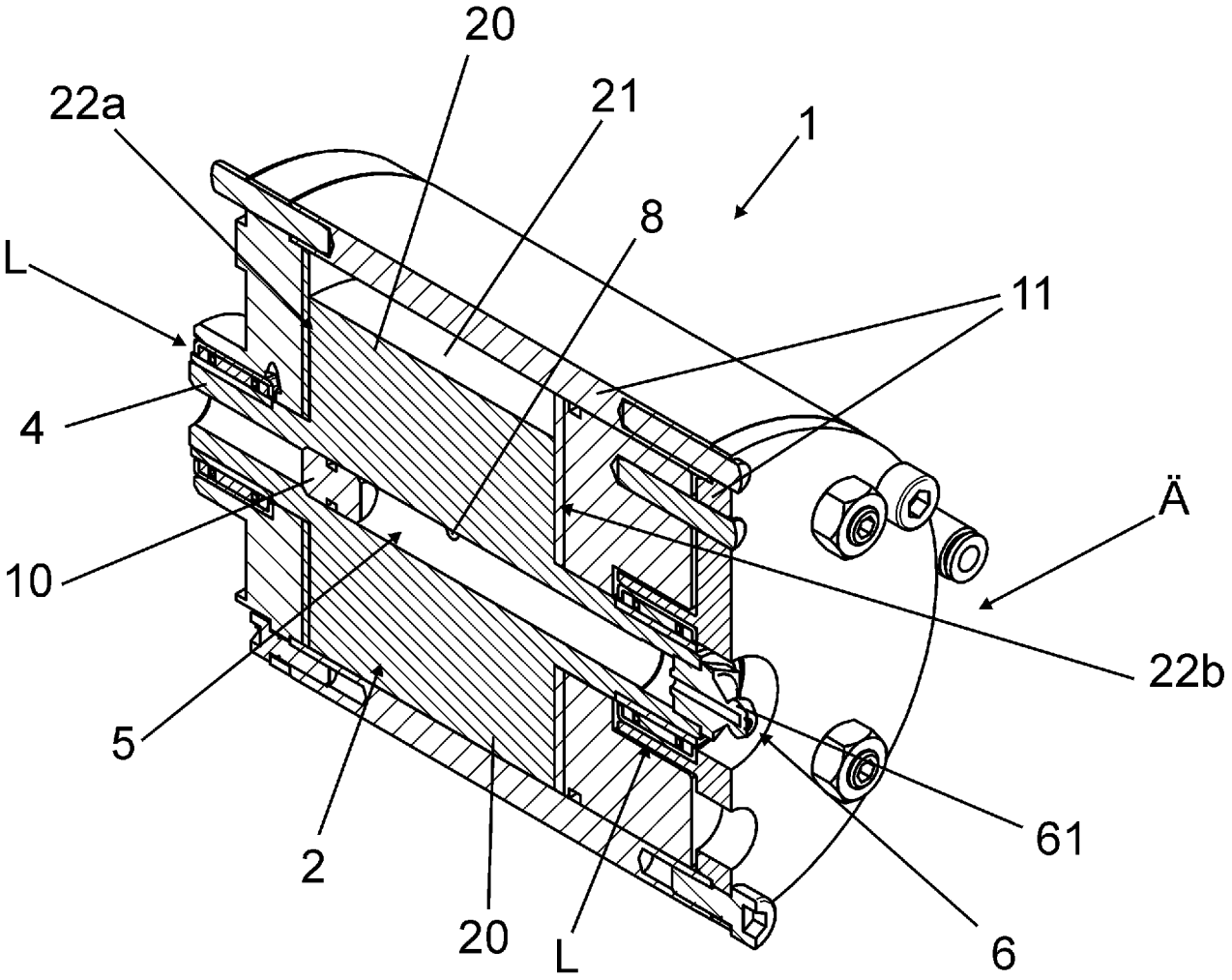
FIG. 2 shows a perspective sectional drawing of the vane motor portrayed in FIG. 1.
Figure 3:
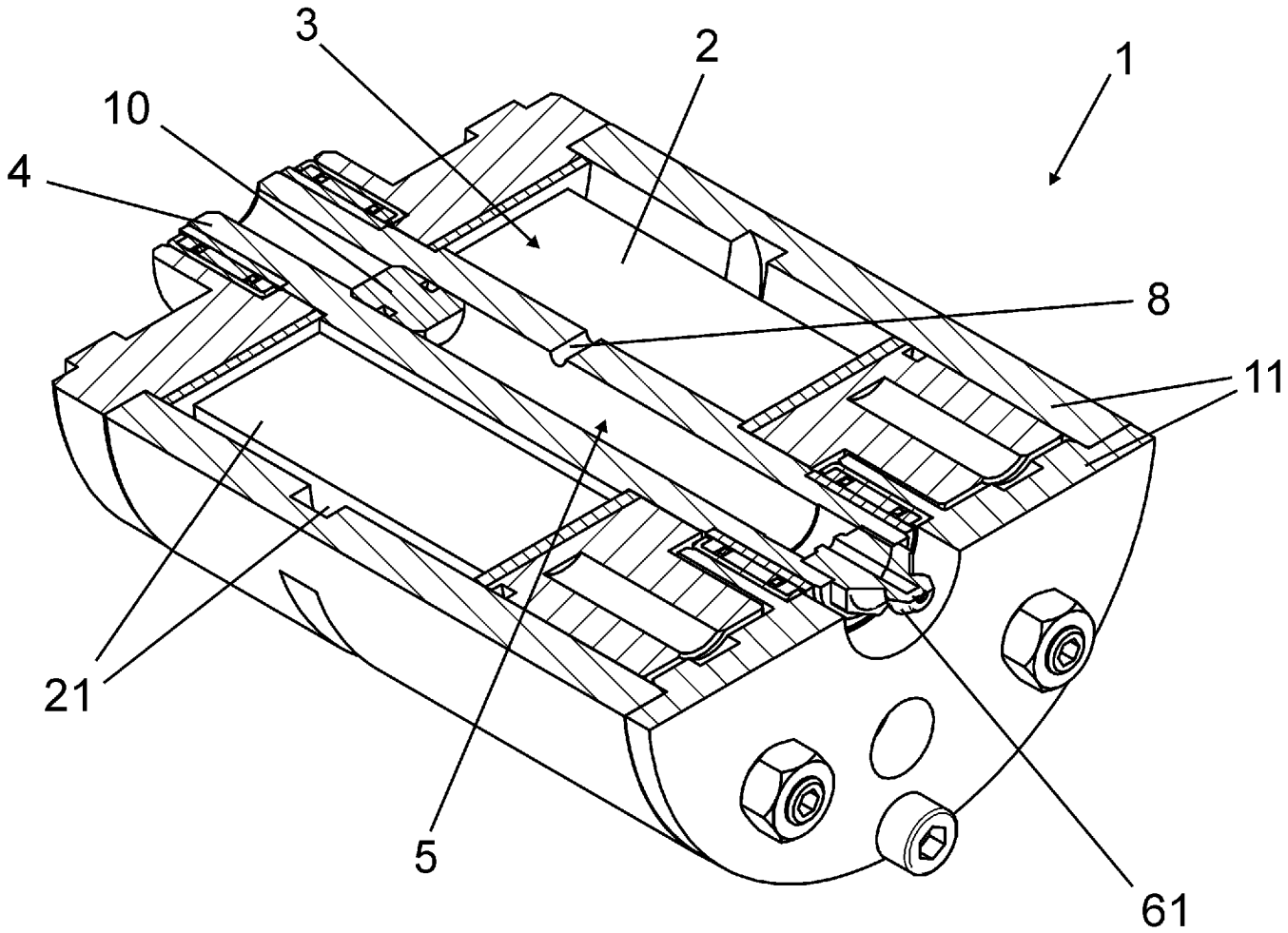
FIG. 3 shows a perspective sectional drawing of the vane motor portrayed in FIG. 2 rotated by 90° relative to FIG. 2.

The rotor shaft 4 is designed as a hollow shaft which is closed on one side by means of a sealing plug 10. The lubrication nipple 61 is arranged on the other side with a lubricant filling opening 6 (see FIG. 2). The volume in the interior of the rotor shaft 4 accordingly forms a first lubricant reservoir 5 for receiving and storing a lubricating grease. The volume of the first lubricant reservoir 5 is 3590 $mm^3$. In the wall of the rotor shaft 4 in the region of the first lubricant reservoir 5, a radial hole is provided which terminates in one of the vane gaps 3 and serves as an outlet opening 8 for lubricant into the vane gap 3 (see FIG. 3). During the operation of the vane motor 1, the lubricant discharging into this vane gap 3 is quickly distributed so that the vanes in the other vane gaps 3 are also lubricated. To prevent a pressure short circuit within the lubricant reservoir 5, it has just one outlet opening 8 leading into a vane gap 3.

Figure 4:
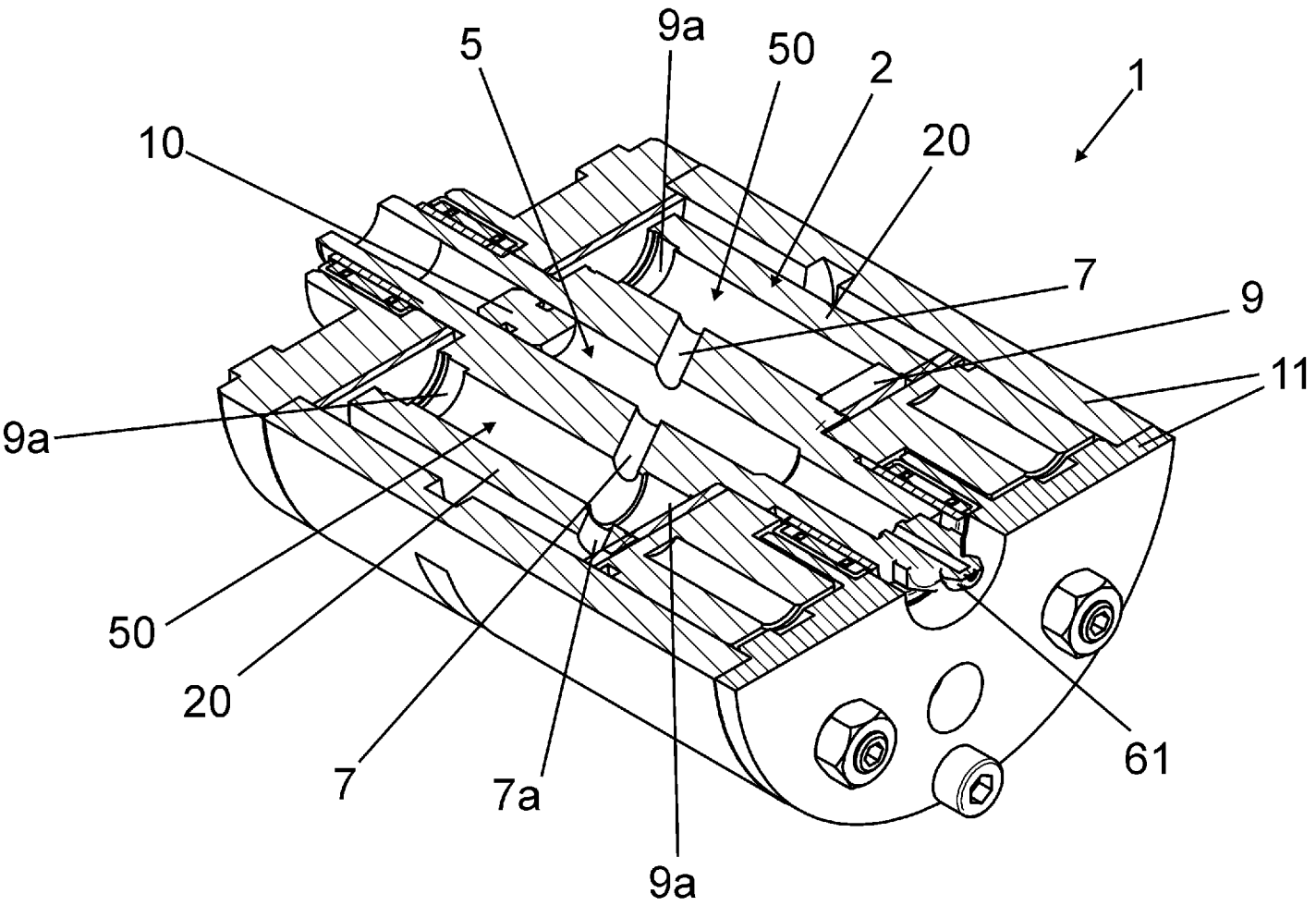
FIG. 4 shows a perspective sectional drawing of the vane motor portrayed in FIG. 3 with a rotor body rotated by 90°.

A further lubricant reservoir 50 is arranged in two opposing sections 20 of the rotor body 2 that are each bordered by two sequential vane gaps 3, wherein the volumes of all lubricant reservoirs 5, 50 are approximately identical. Alternatively, the volume of a further lubricant reservoir 50 can be slightly smaller and in particular approximately 2700 $mm^3$. The two further lubricant reservoirs 50 are each connected by a radial lubricant hole 7 to the first lubricant reservoir 5 in the rotor shaft 4. The lubricant holes 7 are formed as a single hole from the outside of the rotor body 2 so that one of the lubricant reservoirs 50 also has an auxiliary hole 7*a* that arises while drilling the lubricant holes 7 and is subsequently closed using a plug (shown in FIG. 4 without a plug).

The two further lubricant reservoirs 50 are formed as cylindrical holes which are arranged parallel to the rotor shaft 4 and completely penetrate the rotor body 2. Correspondingly, each further lubricant reservoir 50 has an opening in each of the two faces 22*a, b* of the rotor body 2.

In order to ensure a controlled discharge of lubricant, or respectively oil from the lubricating grease through these openings, a disk consisting of sintering material 9 is arranged in each case at both ends of the further lubricant reservoir 50 in a seat region 9*a*, wherein the sintering material 9 permits continuous passage of lubricant on the one hand, and on the other hand, allows the maintenance of a pressure differential in the lubricant reservoir 50 relative to the outside of the rotor body 2. The lubricant leaving there first reaches a region of the vane motor 1 between the face 22*a, b* of the rotor body 2 and the rotor bushing 11 and subsequently distributes evenly within the rotor bushing 11 during operation of the vane motor 1.

The invention claimed is:

1. A vane motor, comprising:

a rotor body driven by compressed air with vane gaps for radially movable vanes, and a rotor shaft for rotatably bearing the rotor body relative to a motor bushing, wherein the rotor shaft is designed as a hollow shaft with a first lubricant reservoir in the interior, the first lubricant reservoir has a lubricant filling opening accessible from outside of the vane motor, and at least one of:

the first lubricant reservoir is connected by at least one radial lubricant hole to at least one further lubricant reservoir arranged in a section of the rotor body between two vane gaps, or the first lubricant reservoir is connected to an outlet opening of at least one further lubricant reservoir arranged in one of the vane gaps for supplying lubricant into the vane gap, and wherein the first lubricant reservoir is provided to receive and to store lubricant, and is formed so that there is no continuous supply of lubricant while the vane motor is operating.

2. The vane motor according to claim 1, wherein a further lubricant reservoir is arranged in at least one section of the rotor body between two vane gaps and has at least one outlet opening for lubricant onto a surface of the rotor body.

3. The vane motor according to claim 1, wherein the outlet opening of the at least one further lubricant reservoir is arranged on at least one face of the rotor body.

4. The vane motor according to claim 1, wherein the outlet opening of the at least one further lubricant reservoir is closed with a sintering material or a membrane material that is configured to let the lubricant pass through.

5. The vane motor according to claim 1, wherein at least two lubricant reservoirs are arranged opposite each other in the rotor body relative to the rotor shaft, wherein one of the at least two lubricant reservoirs is arranged in each section of the rotor body between two vane gaps.

6. The vane motor according to claim 1, wherein just one of the at least one radial lubricant holes is connected to the outlet opening arranged in one of the vane gaps for supplying lubricant into the vane gap.

7. The vane motor according to claim 1, wherein the first lubricant reservoir extends over an entire length of the rotor shaft, wherein the first lubricant reservoir is closed at one end and has the lubricant filling opening at the other end.

8. The vane motor according to claim 1, wherein the first lubricant reservoir is formed by a cylindrical hole arranged centrally within the rotor shaft.

9. The vane motor according to claim 1, wherein a lubrication nipple rotating with the rotor shaft is arranged at the lubricant filling opening.

10. The vane motor according to claim 1, wherein the rotor shaft and the rotor body are formed as a single part.

11. The vane motor according to claim 1, wherein the first lubricant reservoir is connected by at least one radial lubricant hole to at least one further lubricant reservoir arranged in a section of the rotor body between two vane gaps and wherein the at least one further lubricant reservoir is provided to receive and to store lubricant, and is formed so that there is no continuous supply of lubricant while the vane motor is operating.

12. A method to lubricate a vane motor, the vane motor including a rotor body driven by compressed air with vane gaps for radially movable vanes, and a rotor shaft for rotatably bearing the rotor body relative to a motor bushing, wherein the rotor shaft is designed as a hollow shaft with a first lubricant reservoir in the interior, wherein the first lubricant reservoir has a lubricant filling opening accessible from outside of the vane motor, wherein at least one of the first lubricant reservoir is connected by at least one radial lubricant hole to at least one further lubricant reservoir arranged in a section of the rotor body between two vane gaps, or the first lubricant reservoir is connected to an outlet opening of at least one further lubricant reservoir arranged in one of the vane gaps for supplying lubricant into the vane gap, and wherein the first lubricant reservoir is provided to receive and to store lubricant, and is formed so that there is no continuous supply of lubricant while the vane motor is operating, the method comprising the steps of:

connecting a lubricant press to a lubrication nipple arranged on the rotor shaft of the vane motor accessible from the outside of the vane motor, pressing lubricant into at least the first lubricant reservoir arranged in the rotor shaft provided to receive and to store the lubricant, detaching the lubricant press from the lubrication nipple, and operating the vane motor, wherein the lubricant is discharged out of the first lubricant reservoir through at least one outlet opening of the at least one further lubricant reservoir onto the surface of the rotor body and into a vane gap of the rotor body by the rotation of the rotor body and the rotor shaft, wherein there is no continuous supply of lubricant while the vane motor is operating.

13. A method to lubricate a vane motor according to claim 12, wherein lubricant is also pressed into each of further lubricant reservoirs in the rotor body of the vane motor connected to the first lubricant reservoir through a radial lubricant hole.

* * * * *